US006009916A

United States Patent [19]

Krumm

[11] Patent Number: 6,009,916

[45] Date of Patent: Jan. 4, 2000

[54] MOUNTING AND POSITIONING APPARATUS FOR A LENO SELVAGE FORMER

[75] Inventor: Valentin Krumm, Hergensweiler, Germany

[73] Assignee: Lindauer Dornier Gesellschaft mbH, Lindau, Germany

[21] Appl. No.: 08/985,855

[22] Filed: Dec. 5, 1997

[30] Foreign Application Priority Data

Dec. 12, 1996 [DE] Germany ..... 196 51 610

[51] Int. Cl.[7] ..... D03C 7/08; D03D 47/40

[52] U.S. Cl. ..... 139/54; 269/71; 414/749; 901/16

[58] Field of Search ..... 269/55, 71; 414/749, 414/750; 901/16; 139/54

[56] References Cited

U.S. PATENT DOCUMENTS

| | | | |
|---|---|---|---|
| 2,399,880 | 5/1946 | Moessinger . | |
| 3,503,293 | 3/1970 | Sander | 83/481 |
| 4,103,716 | 8/1978 | Cornellier . | |
| 4,353,396 | 10/1982 | Suzuki et al. . | |
| 4,449,884 | 5/1984 | Motoda | 414/749 |
| 4,781,517 | 11/1988 | Pearce et al. | 414/590 |
| 5,162,603 | 11/1992 | Kim | 318/568.11 |
| 5,518,039 | 5/1996 | Haeussler et al. . | |
| 5,524,678 | 6/1996 | Haeussler et al. . | |
| 5,547,330 | 8/1996 | Walimaa et al. | 414/749 |
| 5,586,582 | 12/1996 | Nakada | 139/430 |

FOREIGN PATENT DOCUMENTS

| | | |
|---|---|---|
| 0020796A1 | 1/1981 | European Pat. Off. . |
| 0704564A1 | 4/1996 | European Pat. Off. . |
| 2811275 | 9/1978 | Germany . |
| 2538135C2 | 7/1986 | Germany . |
| 19548955C1 | 9/1996 | Germany . |

*Primary Examiner*—Andy Falik
*Attorney, Agent, or Firm*—W. F. Fasse; W. G. Fasse

[57] ABSTRACT

A leno selvage former is supported by a mounting for position adjustments in the three directions of a three-dimensional rectangular coordinate system and preferably also for an angular position adjustment about at least one rotational axis. For this purpose the mounting has three sections. A first section carries a second section which carries a third section. The first section is, for example adjustable in the Y-direction, while the second section is adjustable in the X-direction and the third section is adjustable in the Z-direction of the rectangular coordinate system. At least one of the three sections is preferably also angularly adjustable. At least one lock such as a screw is provided for locking-in an adjusted position.

9 Claims, 1 Drawing Sheet

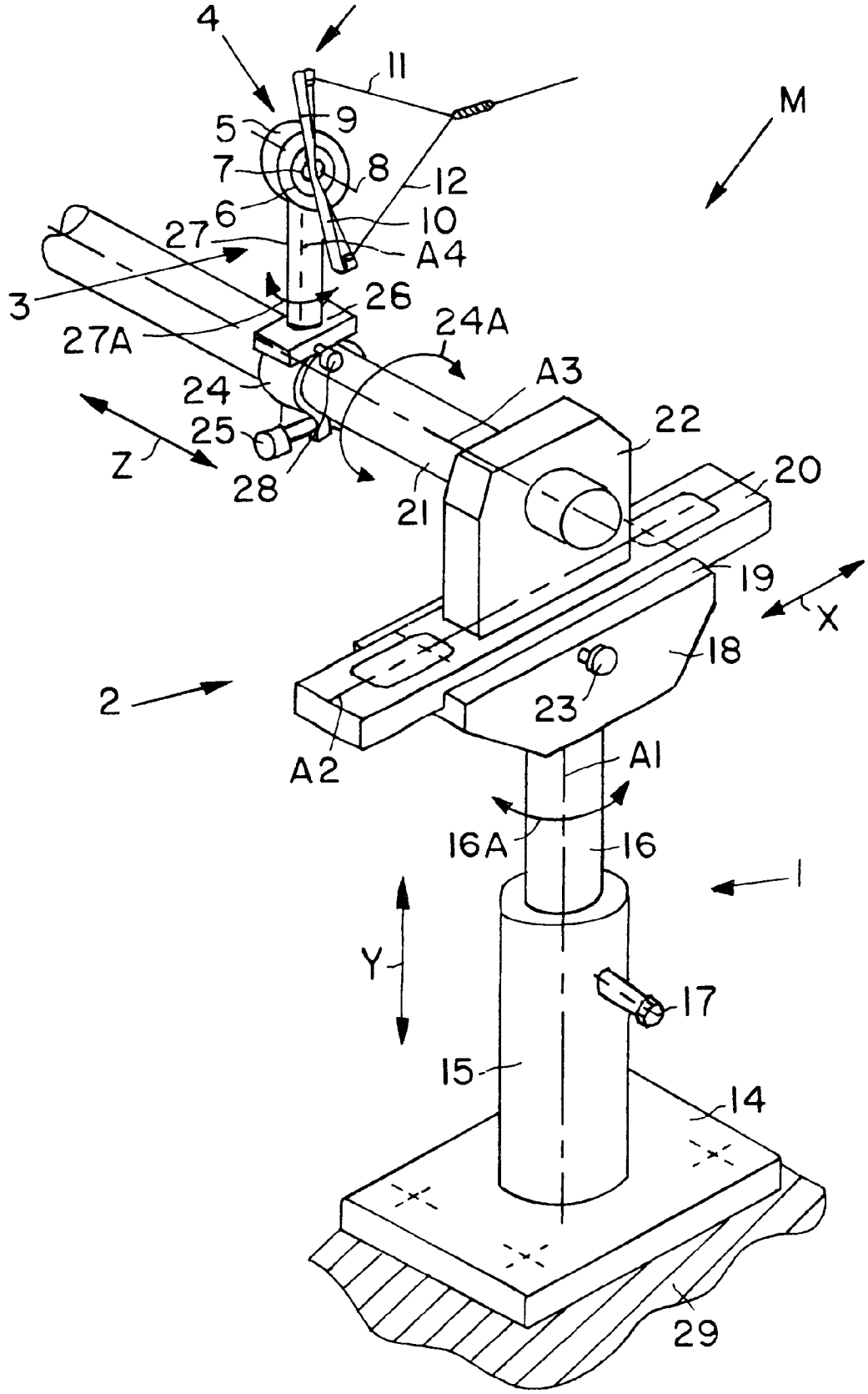
4
11
M
5
9
7
8
12
6
10
27
A4
3
26
27A
24A
A3
24
22
25
20
Z
28
21
19
X
18
2
23
A2
A1
16A
16
1
Y
17
15
14
29

MOUNTING AND POSITIONING APPARATUS FOR A LENO SELVAGE FORMER

FIELD OF THE INVENTION

The invention relates to an apparatus for mounting and position adjusting a leno selvage former in a weaving loom.

BACKGROUND INFORMATION

Leno selvage formers must assume different positions within a loom, for example, when several fabric widths are woven simultaneously on the same loom or when the loom weaving width is adjustable. Leno selvage formers must also be properly positioned relative to the fabric width. Angular position adjustments are required in addition to linear position adjustments in the three directions of space and these position adjustments must be precise. The problem of precision position adjustments for leno selvage formers has not been satisfactorily solved in the art.

OBJECTS OF THE INVENTION

In view of the foregoing it is the aim of the invention to achieve the following objects singly or in combination:

- to provide a position adjustment mounting for a leno selvage former that will permit precise linear position adjustments of the leno selvage former in combination with at least one, preferably several angular position adjustments of the leno former;
- to construct the mounting in such a way that it may be mounted to a loom frame or even independently of the Loom frame; and
- to precisely lock the leno former in an adjusted position.

SUMMARY OF THE INVENTION

According to the invention the holding and positioning device referred to herein as mounting for a leno selvage former comprises three sections including an X-section, a Y-section, and a Z-section. The letters X, Y, Z have reference to the coordinates of a rectangular coordinate system in space. The Y-section is mountable to a support and linearly adjustable along an axis coinciding with or extending in parallel to the Y-direction. The Y-section carries the X-section which is linearly adjustable along an axis coinciding with or extending in parallel to the X-direction. The X-section in turn carries the Z-section which is adjustable along an axis coinciding with or extending in parallel to the Z-direction. Additionally, at least two of the three sections are angularly adjustable or have angularly adjustable components that may be rotated about the respective axis for positional adjustments.

According to the invention the stator of an electric motor, the rotor of which forms part of the leno former, is secured to the Z-section of the present mounting. Due to the several adjustment possibilities, the leno former itself may be position adjusted for the formation of the selvage along fabrics having different widths. More specifically, the leno former is axially displaceable in the Z-direction on a carrier that forms part of the X-section and additionally, the Z-section is rotatable about the Z-axis or rather an axis extending in parallel to the Z-axis. The position of the X-section in a direction parallel to the X-axis is adjustable vertically in its elevational position with the help of the Y-section which also permits rotating the X-section about an axis in parallel to the Y-section. Thus, the rotation of the X-section simultaneously provides a rotation of the Z-section about the axis that extends parallel to the Y-axis. The Y-section may either be mounted to the foundation or floor independently of the frame of the weaving loom or the Y-section may be secured to the weaving loom frame. If desired, the Z-section may also be rotationally adjustable independently of any other adjustments by rotation about an axis extending in parallel to the Y-axis. The sections are lockable in all adjustable positions once an adjustment has been made. Screws, for example set screws, may be used for the locking.

BRIEF DESCRIPTION OF THE DRAWINGS

In order that the invention may be clearly understood, it will now be described, by way of example, with reference to the single FIGURE of the accompanying drawing showing a perspective view of the present mounting providing a plurality of linear and angular adjustment possibilities for a selvage leno former.

DETAILED DESCRIPTION OF A PREFERRED EXAMPLE EMBODIMENT AND OF THE BEST MODE OF THE INVENTION

The present mounting M comprises a Y-section 1 carrying an X-section 2 in turn carrying a Z-section 3 that supports a leno selvage former 4. The letters X, Y, Z refer to a three-dimensional rectangular coordinate system. In a preferred embodiment the selvage former 4 comprises an electric motor with a stator 5 having mounted therein a rotor 6 with a rotor axle 7 having a rotational axis 8 and carrying two leno guide arms 9 and 10 as described in more detail in U.S. Ser. 08/985,854, filed on the same date as the present application (Attorney's Docket No. 3510). The guide arms 9 and 10 guide leno threads 11 and 12 into a leno selvage 13. The disclosure of the just mentioned copending U.S. Patent Application Attorney's Docket No. 3510 is hereby incorporated into the present disclosure by reference.

The Y-section 1 of the present mounting M comprises a base 14, a guide member for example a tubular member 15, and a first linearly adjustable member 16 guided by the tubular member 15 for adjusting an elevational position of the second section or X-section 2 along a vertical first axis A1. For this purpose the second section 2 is secured to the top of the adjustable member 16. The tubular member 15 and the first linearly adjustable member 16 cooperate with each other in a telescoping manner and an adjusted position may be locked by a lock 17 such as a set screw or a screw with a knurled head or the like. The member 16 may itself be tubular or solid. When the lock 17 is loosened, the member 16 may be linearly adjusted up or down in the direction Y of the three-dimensional coordinate system X, Y, Z. Additionally, the first linearly adjustable member 16 may be angularly adjusted as indicated by the rotational arrow 16A when the lock 17 is loosened.

The second section 2 comprises a guide bed 18 forming for example a prismatic guide 19 in which a second adjustable member 20 such as a slide is linearly adjustable in the direction X of the three-dimensional coordinate system. The second section 2 also referred to as the X-section further comprises a carrier 21 such as a cylindrical rod mounted to the second linearly adjustable member 20, for example through a bracket 22 or the like. Thus, the carrier 21 is adjustable back and forth along a second axis A2 in parallel to the X-direction with the slide 20. A second lock 23 such as a set screw or the like 23 locks the slide 20 in an adjusted position relative to the guide bed 18.

The third or Z-section 3 is carried by the carrier 21 that is part of the second section 2. For this purpose the third section 3 comprises a slide bushing 24 slidable back and forth along the carrier 21 in the Z-direction along an axis A3 when a clamping lock 25 such as a screw is loosened. The slide bushing 24 is also preferably adjustable in an angular manner as indicated by the arrow 24A around the axis A3. The third section further comprises a plate 26 and a post 27. The post 27 has a longitudinal axis A4. One end of the post 27 is secured to the plate 26, preferably in a rotatable manner as indicated by the arrow 27A around the axis A4 when a fourth lock 28 is loosened. Thus, the position of the leno selvage former 4 is adjustable back and forth in the directions X, Y and Z as well as back and forth in the direction of the arrows 16A, 24A, 27A.

According to the invention, the base 14 may be secured to a support 29 that is either part of a loom frame or it may be a floor on which the loom is installed. When the support 29 is the floor, the position of the mounting M is independent of the loom frame. Further, one carrier 21 may be supported at each of its ends by a Y-section and an X-section and carry two or more Z-sections distributed along the length of the carrier 21 in accordance with the intended weaving widths.

The detailed construction of the several sections 1, 2 and 3 may differ from the example embodiment shown. For example, the slide 20 does not have to have a rectangular cross-section. A trapezoidal or cylindrical cross-section may be used for the slide 20 with a corresponding formation of the guide bed 18.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A combination comprising a leno selvage former (4) and a mounting (M) for said leno selvage former (4), said mounting comprising a first adjustable section (1) for securing the mounting to a support, a second section (2) attached to said first section, and a third section (3) secured to said second section (2), said first section (1) comprising a first linearly adjustable member (16) for adjusting an elevation position of said second section (2) along a first axis (A1), said second section (2) comprising a carrier (21) carrying said third section (3) and a second linearly adjustable member (20) for positioning said second section (2) along a horizontal second axis (A2), said third section (3) comprising a third linearly adjustable member (24) for positioning said third section (3) along a horizontal third axis (A3) of said carrier (21), said mounting (M) further comprising at least one releasable lock (17) for permitting an angular adjustment of at least one of said first, second and third sections around a rotational axis, so that said leno selvage former (4) is positionable linearly and angularly within a three-dimensional coordinate system (X, Y, Z).

2. The combination of claim 1, further comprising a base (14) mounted to said first section (1) and a support (29) for securing said mounting to said support (29) through said base.

3. The combination of claim 2, wherein said support (29) is adapted to be a floor next to a weaving loom.

4. The combination of claim 2, wherein said support (29) is adapted to be part of a loom frame.

5. The combination of claim 1, wherein said first adjustable section (1) comprises a tubular guide member (15) in which said first linearly adjustable member (16) is slidably received in a telescoping manner for displacement along said first axis (A1), said releasable lock (17) including a first lock for interlocking said tubular guide member (15) and said first linearly adjustable member (16) in an adjusted position, wherein said second section (2) comprises a guide bed (18) in which said second linearly adjustable member (20) is slidably received for displacement along said second axis (A2), and a second lock (23) for locking said second linearly adjustable member (20) to said guide bed (18) in an adjusted position, and wherein said third linearly adjustable member (24) of said third section (3) comprises a slide bushing slidably received on said carrier (21) of said second section (2) for displacement along said third axis (A3), and a third lock (25) for locking said slide bushing on said carrier (21) in an adjusted position.

6. combination of claim 5, wherein said second section (2) comprises a bracket (22) secured to said second linearly adjustable member (20), and wherein said carrier (21.) is secured to said bracket (22).

7. The combination of claim 5, wherein said third section comprises a mounting post (27) having a first post end secured through said slide bushing to said carrier (21) and a second post end secured to said leno selvage former (4).

8. The combination of claim 7, further comprising a plate (26) secured to said slide bushing (24), said first post end being secured to said plate (26) in a rotatable manner for an angular adjustment of said post about a fourth axis (A4), and a fourth lock (28) for locking said post in an angularly adjusted position.

9. The combination of claim 5, wherein said guide bed (18) is a prism guide (19) and wherein said second linearly adjustable member (20) is adapted for riding on said prism guide (19).

* * * * *

UNITED STATES PATENT AND TRADEMARK OFFICE

CERTIFICATE OF CORRECTION

PATENT NO. : 6,009,916
DATED : January 4, 2000
INVENTOR(S) : Krumm

It is certified that error appears in the above-identified patent and that said Letters Patent is hereby corrected as shown below:

Title Page:
Under item [56] "References Cited U.S. PATENT DOCUMENTS".
Line 7, replace "5,162,603 11/1992" by
--5,612,603 3/1997--.

Column 1,
Line 32, replace "loom" by --loom--.

Column 2,
Line 32, after "selvage", replace "13" by --not shown--.

Column 4,
Line 32, before "combination", insert --The--.

Signed and Sealed this

Third Day of July, 2001

*Attest:*

Nicholas P. Godici

*Attesting Officer*

NICHOLAS P. GODICI
*Acting Director of the United States Patent and Trademark Office*